US005265837A

United States Patent [19]

Marocco

[11] Patent Number: 5,265,837

[45] Date of Patent: Nov. 30, 1993

[54] END SUPPORT FOR WINDOW COVERING ASSEMBLY

[76] Inventor: Norbert Marocco, 46 Pennycross Court, Woodbridge, Ontario, Canada, L4L 3M6

[21] Appl. No.: 901,157

[22] Filed: Jun. 19, 1992

[51] Int. Cl.[5] ..... A47H 1/10

[52] U.S. Cl. ..... 248/264; 160/178.1; 160/902

[58] Field of Search ..... 160/178.1, 902, 38, 160/39, 19, 168.1, 176.1; 248/261, 262, 264

[56] References Cited

U.S. PATENT DOCUMENTS

| | | | |
|---|---|---|---|
| 2,267,160 | 12/1941 | McKerlie | 248/264 |
| 2,271,847 | 2/1942 | Stark | 248/264 |
| 2,272,956 | 2/1942 | Stuber et al. | 248/264 |
| 2,587,752 | 3/1952 | Nelson . | |
| 2,670,167 | 2/1954 | Nelson | 248/264 |
| 2,916,246 | 12/1959 | Radel | 248/264 |
| 4,071,215 | 1/1978 | Marotto | 248/264 X |
| 4,079,770 | 3/1978 | Woodle | 160/19 |
| 4,177,853 | 12/1979 | Anderson et al. . | |
| 4,254,814 | 3/1981 | Vecchiarelli | 160/19 |
| 4,265,423 | 5/1981 | Vecchiarelli | 248/264 |
| 4,487,243 | 12/1984 | Debs . | |
| 4,580,753 | 4/1986 | Hennequin | 160/902 X |
| 4,607,677 | 8/1986 | Comeau | 248/264 X |
| 4,662,421 | 5/1987 | Basmadji et al. | 160/39 X |

*Primary Examiner*—David M. Purol

[57] ABSTRACT

An end support for use with a window covering assembly including a head rail having two ends, and the end support having two identical end support structures each end support structures having a generally rectangular open-sided boxlike structure having an end wall, a back wall meeting the end wall generally at a right angle, and two generally horizontal spaced-apart side walls, the side walls being joined to adjacent edges of the end wall and the back wall, the side walls, and the back wall defining free edges, the free edges, in turn, defining a generally three-sided rectangular opening for receiving an end of the head rail, and the side walls defining further free edges which, together with the free edge of the end wall, define an open side of the boxlike structure, through which an end of the head rail may be inserted and removed, and, a moveable closure swingably mounted on the boxlike structure adjacent the free edge of the end wall and swingable between open and closed positions, and a lock for locking the closure in its closed position.

7 Claims, 1 Drawing Sheet

END SUPPORT FOR WINDOW COVERING ASSEMBLY

FIELD OF THE INVENTION

The invention relates to an end support for supporting a window covering assembly and, in particular, to a support such as is used for supporting a mechanical blind such as a venetian blind, or the like at each end.

BACKGROUND OF THE INVENTION

Window covering assemblies such as mechanical blinds usually are based on the same general overall design, namely a head rail device of rigid usually sheet metal material is provided, from which some form of blind or window covering is supported. Usually there is some form of mechanism within the head rail by means of which the blind may be operated between the open and closed positions.

Venetian blinds are one form of such a window covering assembly, and so-called "vertical" blinds are another form, and there are numerous other types of window coverings some involving blinds and others involving some form of moveable draperies such as balloons, "russians", and the like, all of which are usually supported by means of a similar horizontal rigid rail structure, usually known in the art as a "head rail".

Numerous different systems have been employed in the past for supporting such head rails. In some cases, supports are provided to engage the head rail intermediate its two ends, and in other cases supports are provided to engage the head rail at each end. In some cases, the supports are attachable to the wall, or the window frame and, in other cases, the supports may be attachable to a ceiling.

One particularly popular form of support, particularly in the case of venetian blinds, is a generally rectangular boxlike structure, which is provided in pairs, so that there is one such box structure at each end of the head rail. The two ends of the head rail are fitted inside the respective box structures, thereby supporting the blind or window covering in position. To facilitate erection of the blind, and also to facilitate removal of the blind for cleaning or servicing in the like, the boxlike structure usually is provided with an open side, and a door closure device is swingably mounted on the box structure so that it may swing between open and closed positions. Usually some form of simple retaining clip device is provided, engageable between the door and the box structure so that the door may be held closed to retain the end of the head rail in the box.

One particularly popular form of such a boxlike supporting device has been in wide use for supporting venetian blinds. It was made of sheet metal, bent into an open-sided boxlike configuration, and it was provided with a door with a spring clip. Two such boxlike structures were required—one at each end of the head rail.

However, the design of this particularly popular boxlike support device was such that the spring clip lock and the box itself were designed as right and left hand structures. Consequently, it was necessary to have two sets of tooling for manufacturing the two different boxlike structures—one for the right hand, and one for the left hand end. It was then necessary for the manufacturer to stock such supporting structures as right and left hand pairs. It was necessary for the manufacturer to ensure that with every order of blinds that were shipped to a customer, the boxlike supporting ends were shipped in right and left hand pairs.

It was also necessary for the manufacturer to provide complete installation instructions so as to ensure that the supports were erected at the appropriate ends of each blind head rail, since if they were erected the wrong way round, the head rail could not be installed.

All of these disadvantages of this well known popular form of blind support have been known for many years. However, it still remains essentially standard throughout the industry.

In addition to all of these disadvantages, the window covering industry is constantly seeking ways to improve the aesthetic appearance of window coverings and blinds. One way in which this is achieved, particularly with venetian blinds, for example, is to attempt to provide a front cover for the head rail. This front cover is usually provided by means of one or, in some cases, two additional blind slats, which are held in clips extending across the front face of the head rail. This practice has also become virtually standard throughout the industry. However, the design of the rectangular box type of left and right hand end support structures requires that they must fit around the exterior of the head rail at each end, in order to retain it in position. Any form of front covering such as additional blind slats, which is attached to the front of the head rail, must then also be offset forwardly from the front of the head rail sufficient to provide clearance in front of the end supports as well as the head rail.

In addition to this, when it is desired to remove the blind head rail from the end supports for service, it is necessary to first of all remove the slats providing the front covering, in order to have access to the doors on the end supports.

Consequently, whatever structure is provided for supporting the blind slats on the front of the head rail, must be designed in such a way that it can readily be removed and replaced.

In practice, this has proved to be somewhat difficult, and it is not unusual to find that the blind slats on the front of the head rail are somewhat insecure and are easily dislodged during operation of the blind.

BRIEF SUMMARY OF THE INVENTION

With a view to overcoming the various disadvantages of known window covering structures and their supports, the invention comprises an end support apparatus for use in association with a window covering assembly, said assembly including a head rail device adapted to be mounted so as to support said window covering in a desired location, said head rail device defining two ends, and said end support apparatus comprising two identical end support assemblies, each said end support assembly being adapted to be associated with either end of said head rail, and each said end support assembly, in turn, comprising a generally rectangular open-sided boxlike structure having an end wall, a back wall meeting said end wall generally at an angle, and two spaced-apart side walls, said side walls being joined to adjacent edges of said end wall and said back wall, said side walls, and said back wall defining free edges, said free edges, in turn, defining a generally three-sided rectangular opening for receiving an end of said head rail, and said side walls defining further free edges which, together with the free edge of said end wall, define an open side of said boxlike structure, through which said end of said head rail may be inserted and removed, and, identical moveable closure means swingably mounted on said boxlike structure adjacent said free edge of said end wall and swingable between open and closed positions, and locking means for locking said closure in its closed position.

The invention further comprises such an end support structure and wherein said closure incorporates spaced-apart tab members, said tab members being adapted to interengage with said free edges of said side walls when said closure is in said closed position, whereby to restrain the same from spreading apart.

The invention further comprises such an end support structure and wherein said locking means are formed on said side walls, and are operable to engage said closure in spaced-apart locations.

The invention further comprises such an end support structure wherein said upper and lower side walls are mirror images of one another, whereby a said end structure may be placed at either end of said head rail.

The invention further comprises such an end support structure and including opening means formed in said back wall, for receiving fastening devices therethrough, and spacer bar means formed on said back wall between said opening means.

The invention further comprises such an end support structure and including opening means in said end wall for receiving fastening devices, and countersunk recesses formed around said opening means, for receiving heads of fastening devices.

The invention further comprises such an end support structure wherein said window covering assembly includes blind slats of a predetermined colour, and wherein said closure incorporates spaced-apart clip members, adapted to receive a portion of a blind slat, whereby said closure member may be selectively decorated with a portion of the blind slat, said slat being selected so as to correspond to said colour of said slats.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
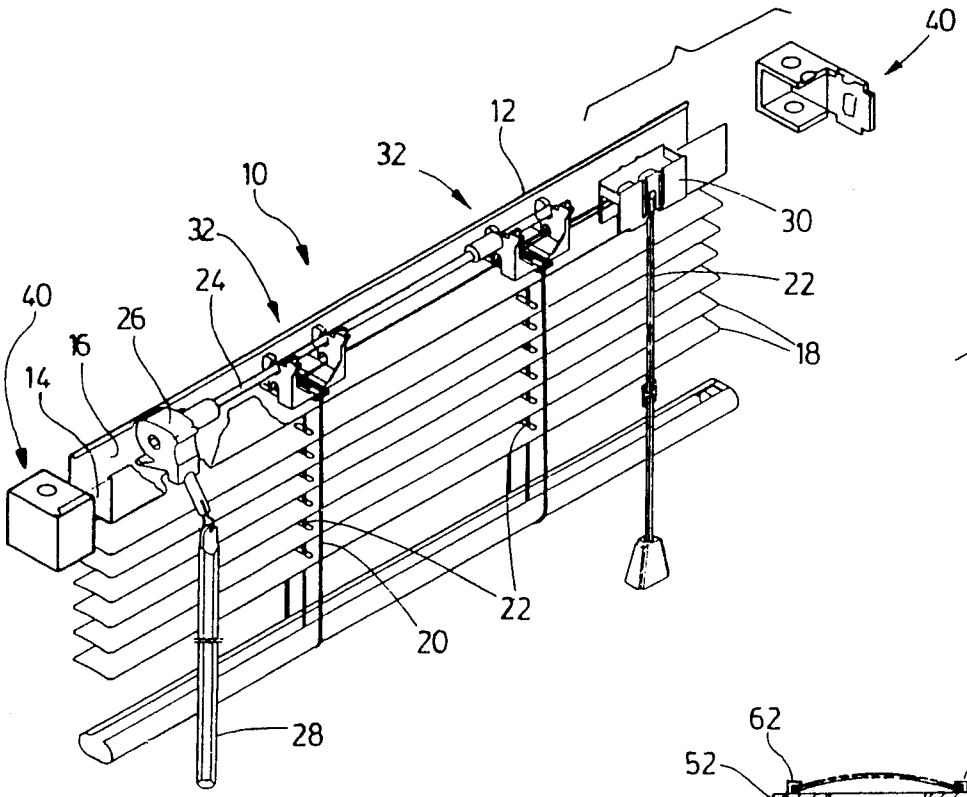
FIG. 1 is an exploded perspective illustration partially cut away of a typical blind assembly, showing one of the end support structures shown at one end thereof.

Referring first of all to FIG. 1, it will be seen that what is illustrated there is a typical form of window covering, in this case, a venetian blind, indicated generally as 10. Such venetian blinds, as is well known in the art, comprise a head rail 12 which is generally of three-sided u-shaped construction having a bottom wall 14 and side walls 16.

The head rail is usually made of roll-formed sheet metal, of regular cross-section along its length.

The various venetian blind components are contained within the head rail. They are not described here, since they may vary from one design of blind to another, and form no part of the present invention. However, in general terms, such a venetian blind comprises a plurality of blind slats 18, suspended on ladder tapes 20.

Raise cords 22 permit the raising and lowering of the slats. The ladder tapes are arranged so that they may be adjusted by means of a control shaft 24 in head rail 12. Control shaft 24, in turn, is controlled by any suitable rotational control means such as, for example, the gears 26 and the wand 28.

A cord lock device 30 is provided for controlling the position of the raise cords 22 so that the blind may be raised or lowered and held in position as desired.

Shaft 24 is rotatably supported in bearing assemblies 32—32, which also contain means for attaching the tapes 20, and for guiding the cords 22.

All of these features, in general terms, are common to venetian blinds, and although they may vary in design from one manufacturer to the other, the details are generally speaking irrelevant to the purposes of this invention.

It will also be appreciated that the invention is applicable to window coverings other than venetian blinds, for supporting each end thereof.

As shown in general, in FIG. 1, the window covering 10 is held in position by means of a two end support apparatus comprising two end support assemblies indicated as 40—40. The two end support assemblies 40 are of identical construction in this embodiment, and can be used at either end of the head rail 12. One such assembly is illustrated in more detail in FIG. 2.

It will be seen to comprise an end wall 42, and a back wall 44 meeting with one another generally at a right angle. Identical upper and lower side walls 46 and 48 extend in parallel spaced-apart relationship, being formed integrally with the edges of end walls 42 and back walls 44.

The end result is a generally four-sided rectangular boxlike structure having two open sides.

The open side defined by the free edges **46*a*, 48*a*, and 44*a* of the side walls 46, 48, and back wall 44 respectively are shaped and adapted so as to matingly receive an end of the head rail 12**.

The free edges **46*b* and 48*b* of the side walls 46 and 48 define an open window, through which the end of the head rail 12** may be inserted by a lateral, substantially horizontal, movement, in a manner to be explained as this description proceeds.

A closure 50 is provided for closing the open window defined by the free edges **46*b* and 48*b*. The closure 50 is of integral one-piece construction, and defines an edge flange 52, which may be swingably interengaged with abutment members 54—54 extending from end wall 42**.

Retention tabs 56—56 are formed on upper and lower edges of closure 50, rendering it useable in a right or left hand location. They are adapted to be matingly received within corresponding recesses 58—58 formed in upper and lower edges of walls 46 and 48 respectively.

Figure 2:
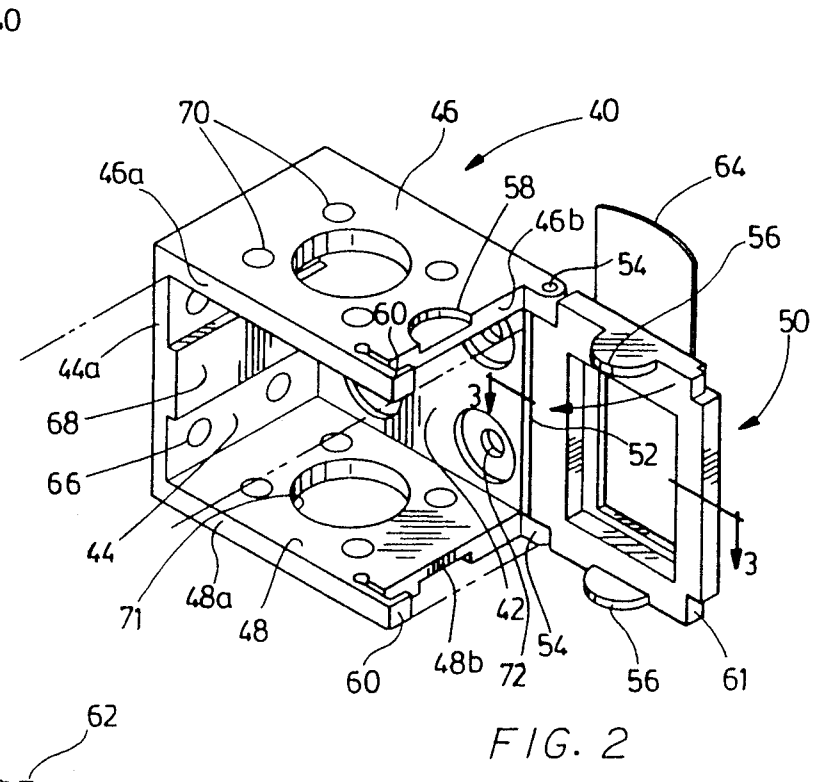
FIG. 2 is a greatly enlarged perspective illustration of the end support assembly illustrated in FIG. 1, partially cut away, and showing alternate positions in phantom, and, FIG. 3 is a section along the line 3—3 of FIG. 2.

Closure retention locks or claws 60—60 are formed on the free edges of **46*a*–48*a* of walls 46–48, and are formed in a generally L-shaped fashion, with a resilient leg portion, whereby they may resiliently flex to and fro, when the closure 50 is swung closed as shown by the arrows in FIG. 2. Closure 50 has upper and lower notches 61—61, registering with claws 60, for receiving claws 60**.

Figure 3:
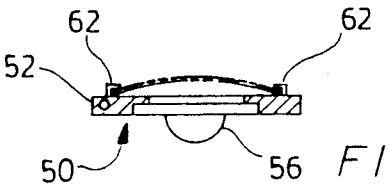

As best shown in FIG. 3, the closure 50 is provided with two opposed trim-retaining grooves 62-62, in which a trim portion 64 of a blind slat may be frictionally received.

For the sake of simplicity, and also for ease of design in moulding the structure, the closure 50 defines a central open window, which reduces the amount of material and, at the same time, speeds up the moulding cycle.

In order to attach the assemblies 40 in position, rear openings 66 are formed through rear wall 44, and a transverse axial reinforcing ridge 68 is formed thereon, for greater strength.

Similarly, if it is desired to suspend the assemblies from the ceiling, this may be achieved by means of inserting screw fastenings (not shown) through openings 70 in either of walls 46 or 48. While the securing of fastenings through the opening 66 can easily be achieved with the closure 50 swung open, the securing of fastenings through the openings 70 is greatly facilitated by the provision of an enlarged central opening 71 in the opposite identical side wall for receiving a tool. Both side walls 46 and 48 are formed identically for this purpose.

In some unusual cases, it may be desirable to attach the assembly by the end wall 42. This may be achieved by placing fastenings (not shown) through openings 72, which are countersunk, so as to receive the heads of the fastenings.

In use, once the two assemblies 40—40 have been secured in position, the correct distance apart, the head rail 12 of the window covering is then slid into one of the assemblies 40. The opposite end of the head rail 12 is then swung by a lateral substantially horizontal movement through the open window defined between free edges **46*b* and 48*b*. The two closures 50 on the two assemblies 40 are then swung shut, and are locked closed by means of the claws 60**.

Trim portions 64 of the blind slats may then be inserted in the grooves 62 if desired.

It will thus be seen that by the use of the invention, it is possible to provide end assemblies for the end support of a horizontal head rail of a window covering, which may be placed at either end, without restriction, consequently the amount of tooling is greatly reduced. It is not necessary to maintain and check this inventory of two separate parts, and when shipping out blinds to customers all that is necessary is to ensure that two such assemblies are shipped with each blind. It is not necessary to check that they are right and left-handed.

In addition, in the directions for attachment of the blind in position, it is not necessary to warn the customer to attach the end assemblies in a right and left-handed fashion, since they are both the same, and may be attached either way around without inconvenience.

An additional advantage of the invention, although not specifically illustrated, is the fact that if it is desired to provide an exterior finish on the head rail, in the form of one or more blind slats attached to the front of the head rail, it is not absolutely necessary for such blind slats to extend so as to cover the end assemblies 40, since they will appear from the front having at least a colour and finish substantially the same as that of the blind slats themselves.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An end support structure for use in association with a window covering assembly, said assembly including a head rail device adapted to be mounted so as to support said window covering in a desired location, said head rail device defining two ends, and said end support structure comprising:

two identical end support structure, each said end support structure being adapted to be associated with either end of said head rail, and each said end support structure, in turn, comprising:

a generally rectangular open-sided boxlike structure having an end wall, a back wall meeting said end wall generally at an angle, and two generally horizontal spaced-apart upper and lower side walls, said side walls being joined to adjacent edges of said end wall and said back wall;

a generally three-sided rectangular opening defined by free edges of said upper and lower side walls, and said back wall for receiving an end of said head rail;

a front opening of said boxlike structure defined by free edges of said upper and lower side walls and said end wall, through which said end of said head rail may be inserted and removed;

a moveable closure swingably mounted on said boxlike structure and swingable relative to said free edges of said upper and lower side walls between open and closed positions;

upper and lower resilient locking claws formed integrally on said free edges of said upper and lower side walls, and resiliently swingable relative to said closure locking for locking said closure in its closed position, and, upper and lower notches formed in said closure in registration with respective said upper and lower locking claws.

2. An end support structure as claimed in claim 1 wherein said closure incorporates spaced-apart tab members, said tab members being adapted to interengage with said free edges of said side walls when said closure is in said closed position, whereby to restrain the same from spreading apart.

3. An end support structure as claimed in claim 1 wherein said side walls are mirror images of one another, whereby a said end structure may be placed at either end of said head rail.

4. An end support structure as claimed in claim 1 and including opening means formed in said back wall, for receiving fastening devices therethrough, and spacer bar means formed on said back wall between said opening means.

5. An end support structure as claimed in claim 1 and including opening means in said end wall for receiving fastening devices, and countersunk recesses formed around said opening means, for receiving heads of said fastening devices.

6. An end support structure as claimed in claim 1 and wherein said closure incorporates spaced-apart clip members, adapted to receive a portion of a blind slat, whereby said closure member may be selectively decorated with a portion of the blind slat, said slat being selected so as to correspond to the slats forming said blind assembly.

7. An end support structure as claimed in claim 3 and including fastening opening means of a first size in both said side walls, and tool opening means of a size greater than said fastening opening means in both said side walls.

* * * * *